US006828944B2

(12) United States Patent
Martiskainen et al.

(10) Patent No.: US 6,828,944 B2
(45) Date of Patent: Dec. 7, 2004

(54) MULTI-BAND SLEEVE DIPOLE ANTENNA

(75) Inventors: Matti Martiskainen, Tiberias (IL); Gennadi Babitski, Nesher (IL)

(73) Assignee: Galtronics Ltd., Tiberias (IL)

( * ) Notice: Subject to any disclaimer, the term of this patent is extended or adjusted under 35 U.S.C. 154(b) by 0 days.

(21) Appl. No.: 10/357,330

(22) Filed: Jan. 30, 2003

(65) Prior Publication Data

US 2004/0017323 A1 Jan. 29, 2004

Related U.S. Application Data

(60) Provisional application No. 60/354,044, filed on Jan. 31, 2002.

(51) Int. Cl.[7] ..... H01Q 9/04
(52) U.S. Cl. ..... 343/792
(58) Field of Search ..... 343/792, 791, 343/790, 702

(56) References Cited

U.S. PATENT DOCUMENTS

| | | | | | |
|---|---|---|---|---|---|
| 4,730,195 | A | | 3/1988 | Phillips | 343/792 |
| 4,748,450 | A | | 5/1988 | Hines et al. | 343/820 |
| 5,079,562 | A | * | 1/1992 | Yarsunas et al. | 343/792 |
| 5,248,988 | A | * | 9/1993 | Makino | 343/792 |
| 5,311,201 | A | * | 5/1994 | Lillie et al. | 343/791 |
| 5,440,317 | A | | 8/1995 | Jalloul et al. | 343/791 |
| 5,604,506 | A | * | 2/1997 | Rodal | 343/791 |
| 6,034,648 | A | | 3/2000 | Hope | 343/790 |
| 6,215,451 | B1 | | 4/2001 | Hadzoglou | 343/715 |
| 6,320,549 | B1 | | 11/2001 | Nybeck et al. | 343/727 |
| 6,337,666 | B1 | | 1/2002 | Bishop | 343/795 |
| 6,421,024 | B1 | * | 7/2002 | Stolle | 343/792 |
| 6,552,692 | B1 | * | 4/2003 | Zeilinger et al. | 343/792 |
| 6,686,892 | B1 | * | 2/2004 | Lopez et al. | 343/791 |

* cited by examiner

*Primary Examiner*—Don Wong
*Assistant Examiner*—Ephrem Alemu
(74) *Attorney, Agent, or Firm*—Ladas & Parry

(57) ABSTRACT

A multi-band sleeve dipole antenna including a generally axially disposed elongate inner conductor having first and second ends and arranged to be connected at the first end thereof to a modulated signal source, a generally axially disposed intermediate conductor disposed generally coaxially with respect to the inner conductor and arranged to be connected to ground, a generally axially disposed first outer sleeve conductor disposed generally coaxially with respect to the inner conductor and to the intermediate conductor and a generally axially disposed second outer sleeve conductor having a first and second ends disposed generally coaxially with respect to the inner conductor and to the intermediate conductor.

9 Claims, 3 Drawing Sheets

MULTI-BAND SLEEVE DIPOLE ANTENNA

REFERENCE TO CO-PENDING APPLICATIONS

Applicant hereby claims priority of U.S. Provisional Patent Application Ser. No. 60/354,044, filed on Jan. 31, 2002, entitled "SLEEVED DIPOLE WITH DAUL BAND PERFORMANCE".

FIELD OF THE INVENTION

The present invention relates to antennas generally and more particularly to dipole antennas.

BACKGROUND OF THE INVENTION

The following U.S. patents are believed to represent the current state of the art:

U.S. Pat. Nos. 4,748,450; 5,079,562; 5,311,201; 6,215,451 and 6,421,024.

SUMMARY OF THE INVENTION

The present invention seeks to provide a cost effective multi-band sleeve dipole antenna.

There is thus provided in accordance with a preferred embodiment of the present invention a multi-band sleeve dipole antenna including a generally axially disposed elongate inner conductor having first and second ends and arranged to be connected at the first end thereof to a modulated signal source, a generally axially disposed intermediate conductor disposed generally coaxially with respect to the inner conductor and arranged to be connected to ground, a generally axially disposed first outer sleeve conductor disposed generally coaxially with respect to the inner conductor and to the intermediate conductor and a generally axially disposed second outer sleeve conductor having a first and second ends disposed generally coaxially with respect to the inner conductor and to the intermediate conductor, the first end being adjacent and axially separated from the first outer sleeve conductor by an axial gap, the first outer sleeve conductor being electrically connected to the intermediate conductor at a feed point location along the inner conductor which is axially separated from the second end thereof by a distance generally equal to one-quarter wavelength of a first radio transmission frequency, the first outer sleeve conductor extending beyond the feed point location by a distance generally equal to one-quarter wavelength of a second radio transmission frequency, which is higher than the first radio transmission frequency, the second outer sleeve conductor being electrically connected to the inner conductor at a location at the second end of the second outer sleeve conductor, and the first end of the second outer sleeve conductor being axially separated from the second end of the inner conductor by a distance equal to one-half wavelength of the second radio transmission frequency.

In accordance with another preferred embodiment of the present invention an inner diameter of the first outer sleeve conductor is selected to define an impedance between the first outer sleeve conductor and the intermediate conductor which is selected to maximize operating bandwidth. Alternatively or additionally, an inner diameter of the second outer sleeve conductor is selected to define an impedance between the second outer sleeve conductor and the inner conductor which is selected to maximize operating bandwidth.

Preferably, the axial gap is selected to provide approximate coupling between the first outer sleeve conductor and the second outer sleeve conductor.

In accordance with still another preferred embodiment of the present invention the multi-band sleeve dipole antenna also includes a coaxial connector having a center pin electrically connected to the inner conductor and an outer connector conductor electrically connected to the intermediate conductor.

Preferably, the second outer sleeve conductor is not electrically connected to the inner conductor at the first end of the second outer sleeve conductor. Additionally or alternatively, the first outer sleeve conductor is not electrically connected to the inner conductor or to the intermediate conductor at an end of the first outer sleeve conductor adjacent the axial gap.

In accordance with a preferred embodiment of the present invention the first and second radio transmission frequencies are generally in the 800 MHz and 1900 MHz bands. Alternatively, the first and second radio transmission frequencies are generally in the 2.4 GHz and 5.6 GHz bands.

There is also provided in accordance with another preferred embodiment of the present invention a multi-band sleeve dipole antenna including a generally axially disposed elongate inner conductor having first and second ends and arranged to be connected at the first end thereof to a modulated signal source, a generally axially disposed intermediate conductor disposed generally coaxially with respect to the inner conductor and arranged to be connected to ground, a generally axially disposed first outer sleeve conductor disposed generally coaxially with respect to the inner conductor and to the intermediate conductor and a generally axially disposed second outer sleeve conductor having a first and second ends disposed generally coaxially with respect to the inner conductor and to the intermediate conductor, the first end being adjacent and axially separated from the first outer sleeve conductor by an axial gap, dimensions and electrical interconnections between the inner conductor, intermediate conductor and first and second outer sleeve conductors being selected so as to provide dipole performance in first and second radio transmission bands.

Preferably, the first and second radio transmission bands are generally in the range of 800 MHz and 1900 MHz. Alternatively, the first and second radio transmission bands are generally in the range of 2.4 GHz and 5.6 GHz.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
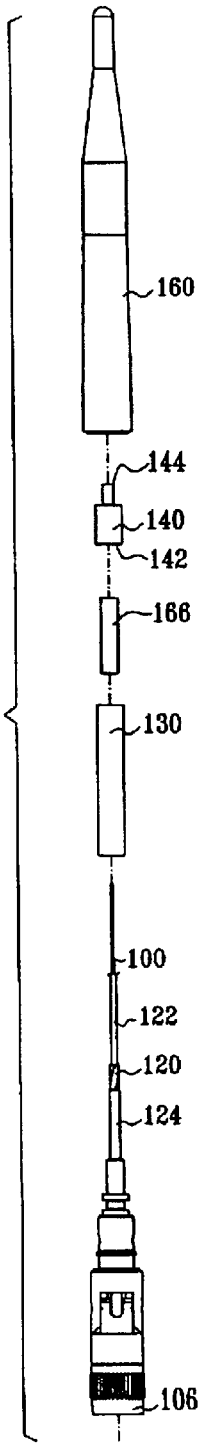
FIG. 1 is a simplified exploded-view side view illustration of a multi-band sleeve dipole antenna constructed and operative in accordance with a preferred embodiment of the present invention.
Figure 2:
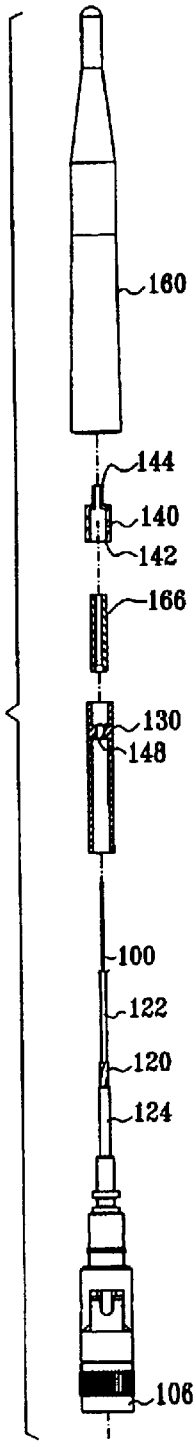
FIG. 2 is a simplified partially sectional exploded-view illustration of the multi-band sleeve dipole antenna of FIG. 1.
Figures 3A, 3B:
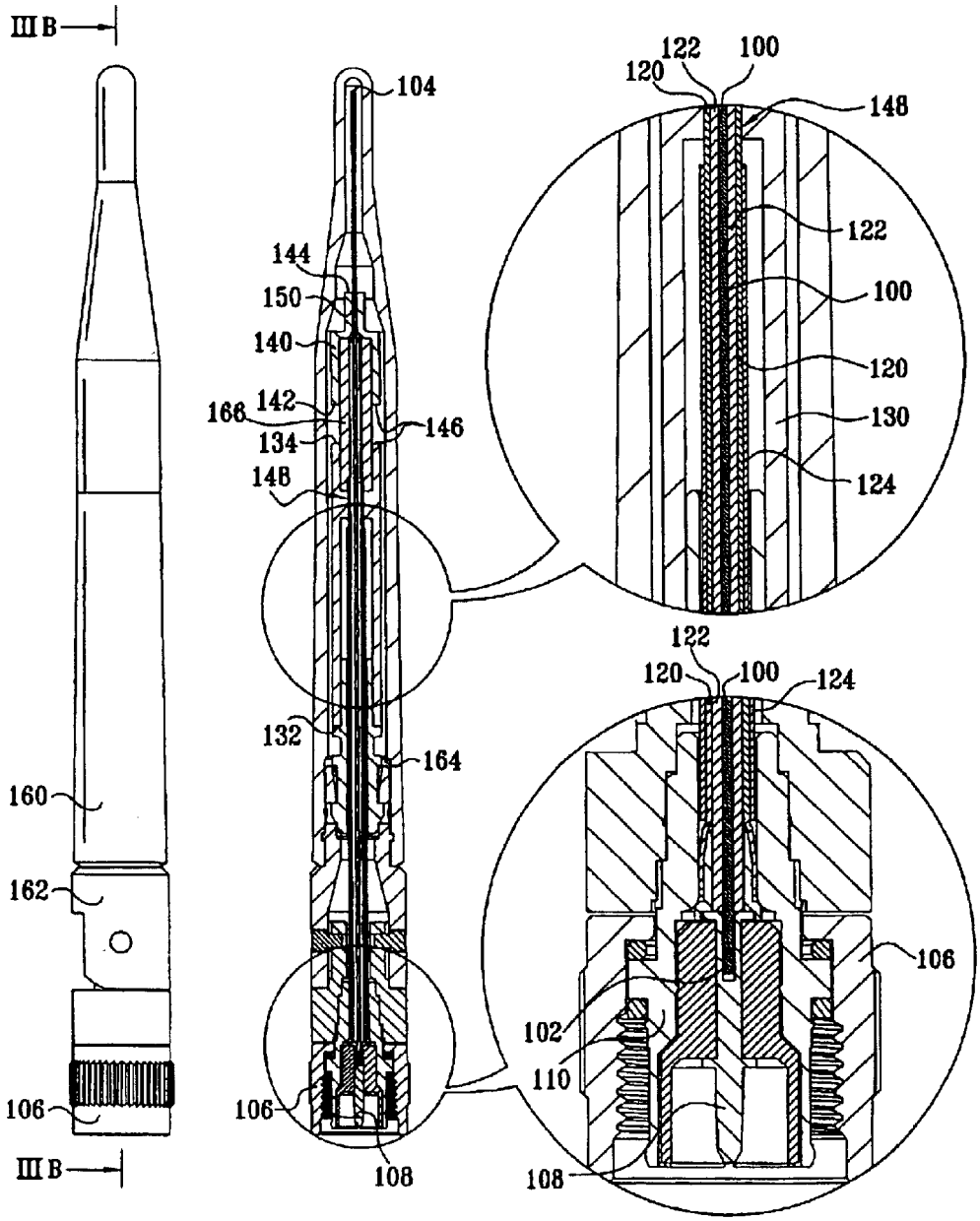
FIG. 3A is a simplified illustration of another orientation of the antenna of FIGS. 1 & 2 in an assembled state.
FIG. 3B is a simplified sectional illustration of the antenna of FIG. 3A taken along lines IIIB—IIIB.
Figure 4:
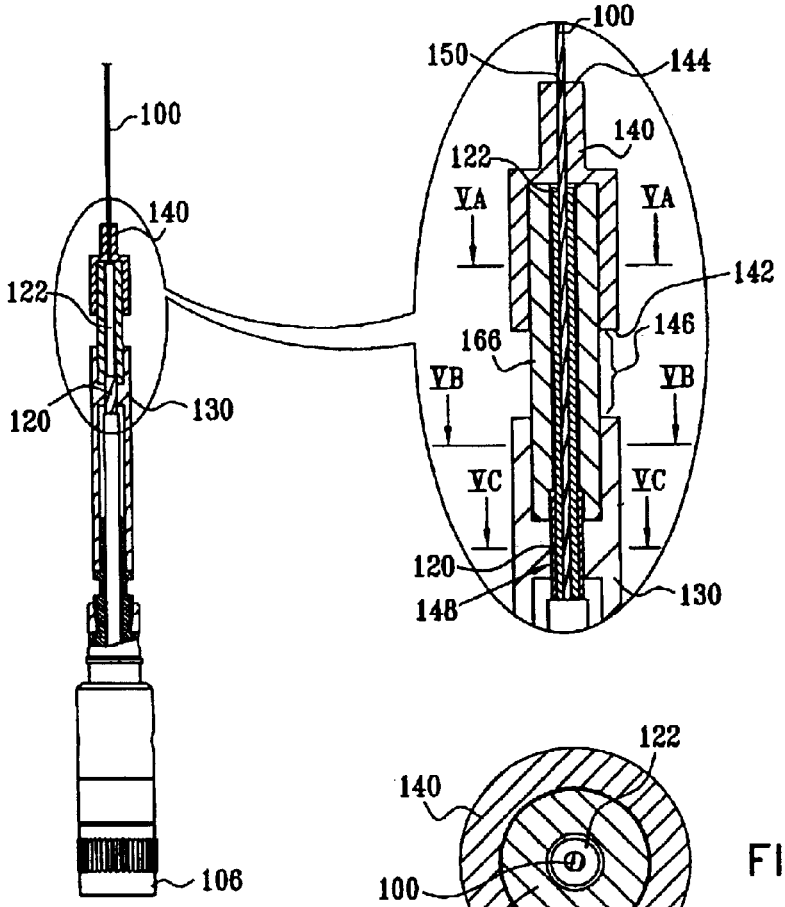
FIG. 4 is a simplified partially sectional illustration of another orientation of the assembled multi-band sleeve dipole antenna of FIG. 3.
Figure 5A:
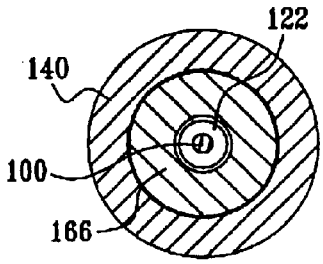
FIGS. 5A, 5B and 5C are sectional illustrations taken along respective lines VA—VA, VB—VB and VC—VC in FIG. 4.
Figure 5B:
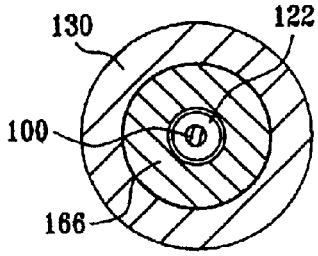
Figure 5C:
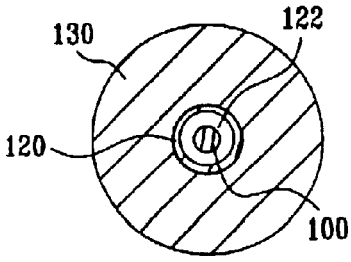

Reference is now made to FIGS. 1–5C, which illustrate a multi-band sleeve dipole antenna constructed and operative in accordance with a preferred embodiment of the present invention.

As seen in FIGS. 1–5C, there is provided a multi-band sleeve dipole antenna which includes a generally axially disposed elongate inner conductor 100 having first and second ends 102 and 104 respectively. Axially disposed elongate inner conductor 100 is arranged to be connected at first end 102 thereof to a modulated signal source, such as a cellular telephone transmitter (not shown), preferably by means of a coaxial connector 106.

Coaxial connector 106 is preferably constructed to have a center pin 108 thereof electrically connected to the inner conductor 100 at first end 102 thereof and an outer connector conductor 110 thereof electrically connected to a generally axially disposed intermediate conductor 120, disposed generally coaxially with respect to the inner conductor 100. Intermediate conductor 120 is preferably embodied in a braid which is disposed about an inner insulative sleeve 122 disposed about inner conductor 100. Intermediate conductor 120 is typically connected to ground via the outer conductor 110. An outer insulative sleeve 124 is preferably provided over the intermediate conductor 120 along a portion of its length.

A generally axially disposed first outer sleeve conductor 130, having respective first and second ends 132 and 134, is preferably disposed generally coaxially with respect to inner conductor 100 and with respect to intermediate conductor 120. There is additionally provided a generally axially disposed second outer sleeve conductor 140 having respective first and second ends 142 and 144. Second outer sleeve conductor 140 is preferably disposed generally coaxially with respect to the inner conductor 100 and to the intermediate conductor 120. Preferably, the first end 142 of the second outer sleeve conductor 140 lies adjacent to and is axially separated from the second end 134 of the first outer sleeve conductor 130 by an axial gap 146.

The axial gap 146 is preferably selected to provide impedance matching between the first outer sleeve conductor 130 and the second outer sleeve conductor 140. The first outer sleeve conductor 130 is not electrically connected to the inner conductor 100 or to the intermediate conductor 120 at end 132 of the first outer sleeve conductor 130 adjacent the axial gap 146.

Preferably, the first outer sleeve conductor 130 is electrically connected to the intermediate conductor 120 at a feed point location 148 along the inner conductor 100 which is axially separated from the second end 104 thereof by a distance generally equal to one-quarter wavelength of a first radio transmission frequency.

Preferably, the first outer sleeve conductor 130 extends beyond the feed point location 148 to end 134 by a distance generally equal to one-quarter wavelength of a second radio transmission frequency, which is higher than the first radio transmission frequency. Typically first and second radio transmission frequencies are in the 800 MHz and 1900 MHz bands respectively. Alternatively, the first and second radio transmission frequencies may be in the 2.4 GHz and 5.6 GHz transmission bands respectively.

Preferably, the second outer sleeve conductor 140 is electrically connected to the inner conductor 100 at a location 150 at the second end 144 of the second outer sleeve conductor 140. Additionally, the first end 142 of the second outer sleeve conductor 140 is axially separated from the second end 104 of the inner conductor 100 by a distance equal to one-half wavelength of the second radio transmission frequency. The second outer sleeve conductor 140 is not electrically connected to the inner conductor 100 at the first end 142 of the second outer sleeve conductor.

Preferably, an inner diameter of the first outer sleeve conductor 130 defines an impedance between the first outer sleeve conductor 130 and the intermediate conductor 120 which is selected to maximize operating bandwidth. A typical impedance is 50 ohms.

Preferably, an inner diameter of the second outer sleeve conductor 140 is selected to define an impedance between the second outer sleeve conductor 140 and the inner conductor 100 which is selected to maximize operating bandwidth. A typical impedance is 50 ohms.

Preferably, a RF transmissive electrically insulative protective cover 160 is provided to cover the antenna and is mounted on a pivotably mounted support 162, which is arranged for pivotable mounting relative to coaxial connector 106. An internal mounting element 164 is supported onto support 162 and supports the first outer sleeve conductor 130. The second outer sleeve conductor 140 is supported onto a generally cylindrical spacer 166 which is preferably seated in recesses formed in both the first and second outer sleeve conductors 130.

It is also a particular feature of the present invention that the dimensions of and electrical interconnections between inner conductor 100, intermediate conductor 120 and first and second outer sleeve conductors 130 and 140 respectively are selected so as to provide (1) structure for a balun for the higher transmission band by extension of first outer sleeve 130, (2) suitable feeding for the higher frequency band by axial gap 146 and (3) necessary bandwidth for the higher transmission band. The bandwidth is regulated by impedance, which is a function of the size of the axial gap 146 and the ratio between the outer and inner diameters of the extension of first outer sleeve conductor 130 vs. inner conductor 100 and the ratio between the outer and inner diameters of the second outer sleeve conductor 140 vs. inner conductor 100 and the dielectric sleeves between them. The impedance is also a function of the length of the second outer sleeve conductor 140. These parameters are strong enough to provide bandwidth covering both PCS and DCS bands, in the range of 1850–1990 MHz and 1710–1880 MHz. A dipole performance is achieved on both transmission bands, or on multiple transmission bands, because the main elements of dipole are included—radiation elements reaching electrical length of ½ wavelength and a balun providing matching between the balanced and unbalanced system.

It will be appreciated by persons skilled in the art that the present invention is not limited to what has been particularly shown and described hereinabove. Rather the scope of the present invention includes both combinations and subcombinations of the various features described hereinabove as well as modifications and variations thereof as would occur to a person of skill in the art upon reading the foregoing specification and which are not in the prior art.

What is claimed is:

1. A multi-band sleeve dipole antenna comprising:

a generally axially disposed elongate inner conductor having first and second ends and arranged to be connected at said first end thereof to a modulated signal source;

a generally axially disposed intermediate conductor disposed generally coaxially with respect to said inner conductor and arranged to be connected to ground;

a generally axially disposed first outer sleeve conductor disposed generally coaxially with respect to said inner conductor and to said intermediate conductor; and a generally axially disposed second outer sleeve conductor having a first and second ends disposed generally coaxially with respect to said inner conductor and to said intermediate conductor, said first end being adjacent and axially separated from said first outer sleeve conductor by an axial gap, said first outer sleeve conductor being electrically connected to said intermediate conductor at a feed point location along said inner conductor which is axially separated from said second end thereof by a distance generally equal to one-quarter wavelength of a first radio transmission frequency, said first outer sleeve conductor extending beyond said feed point location by a distance generally equal to one-quarter wavelength of a second radio transmission frequency, which is higher than said first radio transmission frequency, said second outer sleeve conductor being electrically connected to said inner conductor at a location at said second end of said second outer sleeve conductor, and said first end of said second outer sleeve conductor being axially separated from said second end of said inner conductor by a distance equal to one-half wavelength of said second radio transmission frequency.

2. A multi-band sleeve dipole antenna according to claim 1 and wherein an inner diameter of said first outer sleeve conductor is selected to define an impedance between said first outer sleeve conductor and said intermediate conductor which is selected to maximize operating bandwidth.

3. A multi-band sleeve dipole antenna according to claim 1 and wherein an inner diameter of said second outer sleeve conductor is selected to define an impedance between said second outer sleeve conductor and said inner conductor which is selected to maximize operating bandwidth.

4. A multi-band sleeve dipole antenna according to claim 1 and wherein said axial gap is selected to provide approximate coupling between said first outer sleeve conductor and said second outer sleeve conductor.

5. A multi-band sleeve dipole antenna according to claim 1 and also comprising a coaxial connector having a center pin electrically connected to said inner conductor and an outer connector conductor electrically connected to said intermediate conductor.

6. A multi-band sleeve dipole antenna according to claim 1 and wherein said second outer sleeve conductor is not electrically connected to said inner conductor at said first end of said second outer sleeve conductor.

7. A multi-band sleeve dipole antenna according to claim 1 and wherein said first outer sleeve conductor is not electrically connected to said inner conductor or to said intermediate conductor at an end of said first outer sleeve conductor adjacent said axial gap.

8. A multi-band sleeve dipole antenna according to claim 1 and wherein said first and second radio transmission frequencies are generally in the 800 MHz and 1900 MHz bands.

9. A multi-band sleeve dipole antenna according to claim 1 and wherein said first and second radio transmission frequencies are generally in the 2.4 GHz and 5.6 GHz bands.

* * * * *